US010413055B2

(12) United States Patent
Laudadio et al.

(10) Patent No.: US 10,413,055 B2
(45) Date of Patent: Sep. 17, 2019

(54) MOTORIZED, HEIGHT ADJUSTABLE DESKTOP SYSTEM

(71) Applicants: Christopher Laudadio, Los Angeles, CA (US); Aryan Jafari, Los Angeles, CA (US)

(72) Inventors: Christopher Laudadio, Los Angeles, CA (US); Aryan Jafari, Los Angeles, CA (US)

(73) Assignee: Versa Products, Inc., Los Angeles, CA (US)

( * ) Notice: Subject to any disclaimer, the term of this patent is extended or adjusted under 35 U.S.C. 154(b) by 0 days.

(21) Appl. No.: 15/642,842

(22) Filed: Jul. 6, 2017

(65) Prior Publication Data

US 2018/0008037 A1 Jan. 11, 2018

Related U.S. Application Data

(60) Provisional application No. 62/359,996, filed on Jul. 8, 2016.

(51) Int. Cl.

| | |
|---|---|
| ***A47B 23/04*** | (2006.01) |
| ***A47B 21/04*** | (2006.01) |
| ***A47B 21/02*** | (2006.01) |
| ***A47B 9/18*** | (2006.01) |
| ***A47B 21/03*** | (2006.01) |
| ***A47B 9/16*** | (2006.01) |
| ***A47B 21/06*** | (2006.01) |

(52) U.S. Cl.

CPC ..... *A47B 23/04* (2013.01); *A47B 9/16* (2013.01); *A47B 9/18* (2013.01); *A47B 21/02* (2013.01); *A47B 21/0314* (2013.01); *A47B 21/04* (2013.01); *A47B 21/06* (2013.01); *A47B 2021/0335* (2013.01); *A47B 2023/049* (2013.01); *A47B 2200/0082* (2013.01)

(58) Field of Classification Search

CPC ..... A47B 9/16; A47B 9/10
USPC ..... 108/145, 147
See application file for complete search history.

(56) References Cited

U.S. PATENT DOCUMENTS

| | | | | |
|---|---|---|---|---|
| 4,625,657 | A * | 12/1986 | Little | A47B 21/0314 108/138 |
| 5,771,814 | A * | 6/1998 | Clausen | A47B 21/0314 108/93 |
| 6,269,753 | B1 * | 8/2001 | Roddan | A47B 21/00 108/50.01 |
| 6,286,812 | B1 * | 9/2001 | Cherry | B66F 7/065 254/122 |
| 6,397,763 | B1 * | 6/2002 | Panzarella | A47B 21/0314 108/138 |
| 6,585,214 | B1 * | 7/2003 | Dittmer | F16M 11/38 248/370 |

(Continued)

*Primary Examiner* — Jose V Chen
(74) *Attorney, Agent, or Firm* — Marin Patents LP; Gustavo Marin

(57) ABSTRACT

A motorized desktop stand unit having a main surface assembly designed to accommodate a monitor or laptop and a secondary surface assembly designed to accommodate a keyboard. The desktop stand unit also has a frame assembly having an upper frame and a lower frame. An elevation mechanism is provided between the upper frame and lower frame. A switch provided in the main surface assembly, when actuated, causes the elevation mechanism to adjust the space between the upper frame and lower frames, changing the height of the main surface assembly.

6 Claims, 9 Drawing Sheets

(56) References Cited

U.S. PATENT DOCUMENTS

| | | | | |
|---|---|---|---|---|
| 7,677,518 | B2 * | 3/2010 | Chouinard | A47B 21/02 108/10 |
| 7,950,338 | B2 * | 5/2011 | Smed | A47B 9/16 108/119 |
| 8,947,215 | B2 * | 2/2015 | Mandel | G06Q 10/109 108/147 |
| 9,055,810 | B2 * | 6/2015 | Flaherty | A47B 9/18 |
| 9,326,598 | B1 * | 5/2016 | West | A47B 3/02 |
| 9,332,839 | B2 * | 5/2016 | Ringlein | A47B 87/002 |
| 9,504,316 | B1 * | 11/2016 | Streicher | A47B 21/02 |
| 9,615,655 | B1 * | 4/2017 | Huang | A47B 9/16 |
| 9,681,746 | B1 * | 6/2017 | Chen | A47B 9/16 |
| 2004/0149177 | A1 * | 8/2004 | Gayhart | A47B 21/06 108/50.02 |
| 2005/0284341 | A1 * | 12/2005 | Klassy | A47B 21/00 108/50.02 |
| 2013/0145972 | A1 * | 6/2013 | Knox | B60N 3/063 108/145 |
| 2015/0289641 | A1 * | 10/2015 | Ergun | A47B 9/16 108/42 |
| 2016/0249737 | A1 * | 9/2016 | Han | B60P 3/34 108/145 |
| 2016/0286951 | A1 * | 10/2016 | Chung | A47B 9/16 |
| 2016/0338486 | A1 * | 11/2016 | Martin | A47B 9/16 |

* cited by examiner

MOTORIZED, HEIGHT ADJUSTABLE DESKTOP SYSTEM

CROSS-REFERENCE TO RELATED APPLICATION

This application claims priority to U.S. Provisional Application No. 62/359,996, filed Jul. 8, 2016, which is hereby incorporated by reference in its entirety as if fully recited herein.

BACKGROUND OF THE INVENTION

The present invention relates generally to computer furniture, in particular, to a motorized, height-adjustable desktop or a motorized standing desk converter.

As the computer has become a centerpiece of work and other daily activities, there has become a need for height-adjustable computer furniture, in particular, a furniture system that allow for a user to go from a sitting position in front of a computer to a standing position in front of a computer with ease. It has been shown that sitting for long periods of time can be harmful to one's heath. As such, these systems allow for a user to continue to use a computer while changing his/her position from standing from sitting, alleviating back pain commonly attributed to sitting for long periods, for example.

In order to convert computer furniture from a position in which a user is sitting to a position in which a user is standing, various lift mechanisms have been used. One example is a manual, spring-assisted lift mechanism. However, such a manual mechanism requires a user to lift the portion of the desktop, a desktop which often has heavy computer equipment thereon. General examples of older systems include those disclosed in U.S. Pat. No. 5,868,079 and U.S. Patent Publication No. 2008/0203865.

Accordingly, there is a need for an improved, height-adjustable desktop system that allows a user to achieve a desired desktop height without manual adjustment.

BRIEF DESCRIPTION OF THE DRAWINGS

A more complete understanding of the present invention may be obtained by reference to the Detailed Description when taken in conjunction with the accompanying Drawings.

SUMMARY OF THE INVENTION

A motorized desktop stand unit comprising a main surface assembly designed to accommodate a monitor or laptop; a secondary surface assembly slideably attached to said main surface assembly designed to accommodate a keyboard; a frame assembly comprising an upper frame and a lower frame; an elevation mechanism provided between said upper frame and lower frame; and a switch provided in said main surface assembly; wherein when said switch is actuated, the elevation mechanism adjusts the space between said upper frame and lower frame, changing the height of the main surface assembly.

DETAILED DESCRIPTION OF THE DRAWINGS

Figure 1:
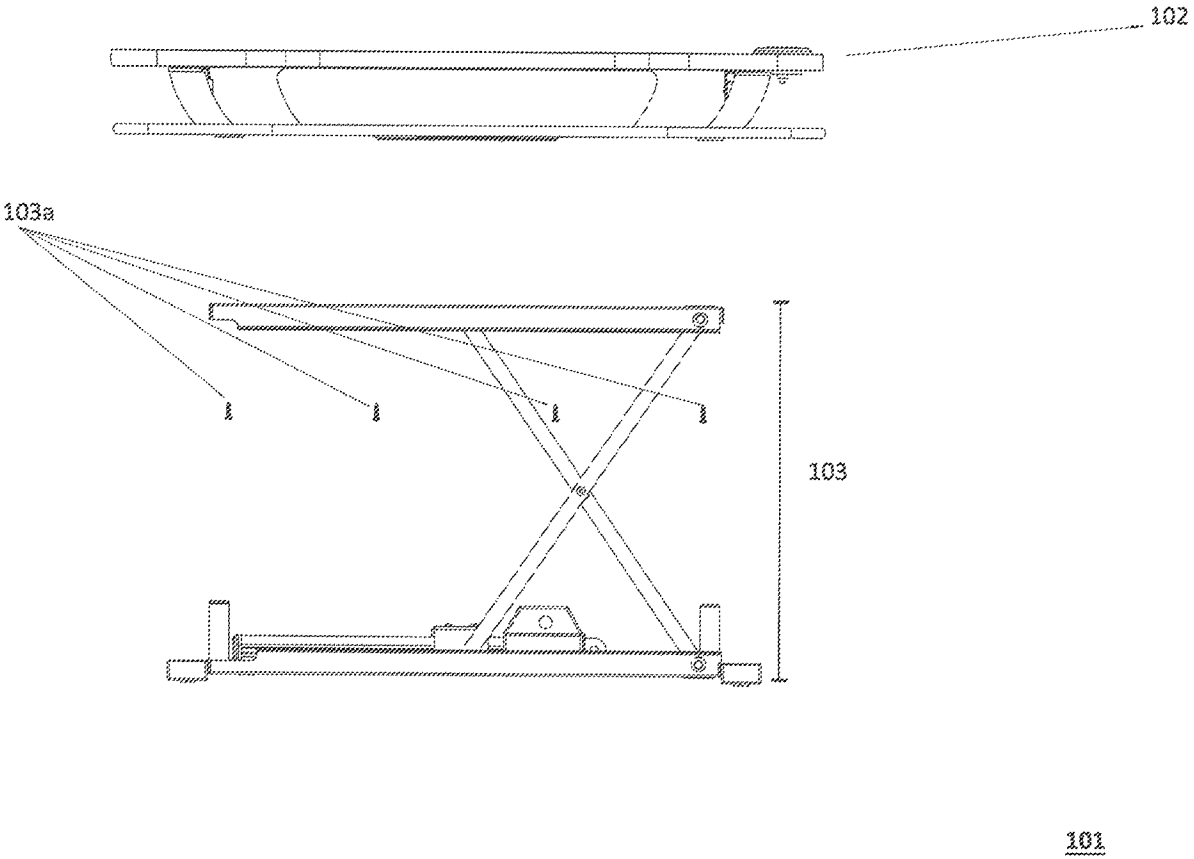
FIG. 1 shows an partial exploded view of exemplary desktop system.

Referring now to the figures, FIG. 1 shows an exemplary desktop system 101 with surface assembly 102 and frame assembly 103. Frame assembly 103 comprises a scissor assembly, discussed further in detail with respect to FIG. 2. Scissor assembly aids in allowing the frame assembly 103 to be adjusted to/positioned at varying heights. Screws 103*a* are used to attach frame assembly 103 to main surface 102.

Figure 2:
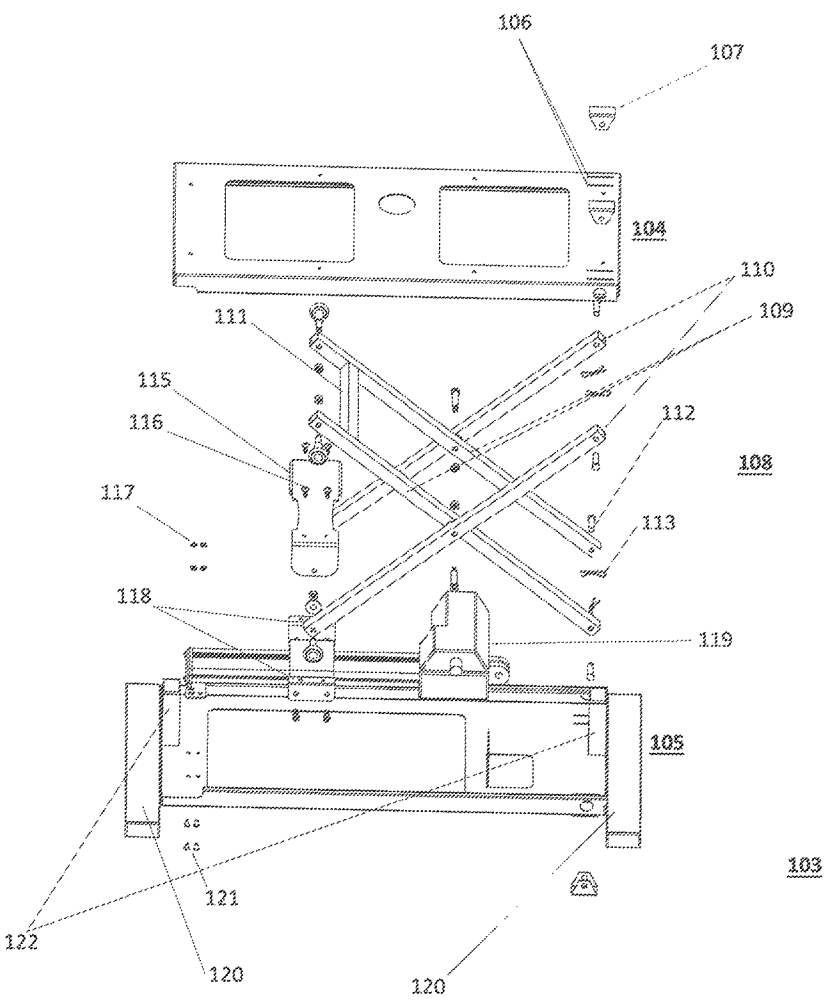
FIG. 2 shows an exploded view of the frame assembly of the exemplary desktop system.
Figure 2:
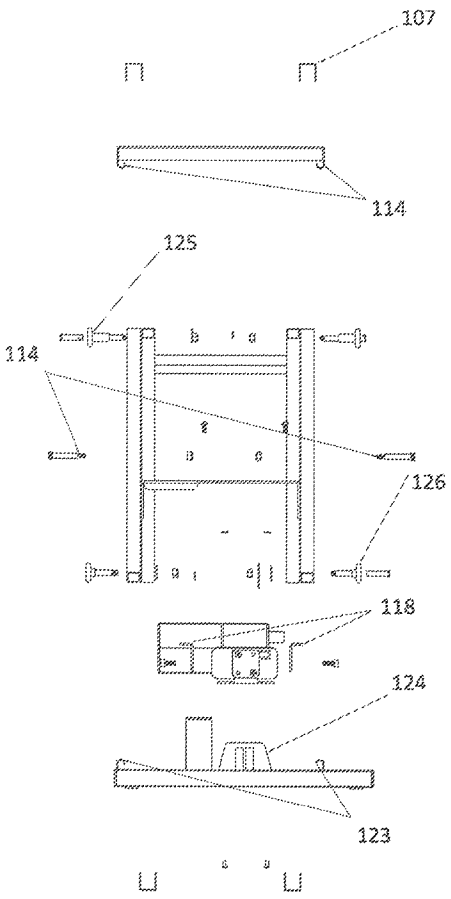

FIG. 2 shows an exploded view of frame assembly 103. Frame assembly 103 has upper tray 104 and lower tray 105. Upper tray 104 has cut outs 106 in a surface thereof to allow U-shaped hinge brackets 107 to pass through upper tray 104. U-shaped hinge brackets 107 have openings at distal ends thereof to allow the hinge brackets 107 to be secured to scissor arms 108 with fasteners. Bottom tray 105 also has cut outs and corresponding U-shaped hinge brackets to attach scissor arms to bottom tray 105.

Scissor arms 108 generally comprise inner scissor arms 109 and outer scissor arms 110. Inner scissor arms 109 and outer scissor arms 110 form a crisscross shape and move around a pin at a center of scissor arms 109 and 110. Reinforcer tube 111 is attached at one end of inner scissor arms 109 to maintain a set distance between the arms and to allow the arms to move together in parallel. Reinforcer tube 111 also gives the system stability when the frame assembly is raised into an elevated position.

Clevis pins 112 and cutter pins 113 are used to connect the scissor arms 109 and 110 to the top tray 104 and bottom tray 105 via the U-shaped hinge brackets 108.

U-shaped tracks 114 and 123 are provided in upper and lower trays 104 and 105, respectively, to accept roller wheels, discussed below. Carrier bracket 115 is provided at one end of the scissor arms 109 and 110 to transfer the force of the electric motor 119 to the scissor arms 109 and 110. Self-tapping screw 116 connects carrier bracket 115 to ear flanges 118 to connect the motor 119 to the carrier bracket 115.

Bottom tray 105 has welded tubes 120 to provide stability to the assembly. Pop rivets 121 secure the motor to the lower tray 105. Washers 117 are provided to the back of pop rivets 121. Stop tubes 122 are provided at opposing ends of lower tray 105 to provide a resting/stabilizing point for the upper tray 104. Flange 124 is provided on the lower tray to secure the back of motor 119.

Roller wheels 125 and 126 are connected at one end of scissor arms 109 and 110. Roller wheels 125 are customized and have an integrated stand off. The integrated stand off provides appropriate spacing from tube arms 109 and also for the roller wheels 125 to be placed into the U-shaped tracks 114.

Figure 3:
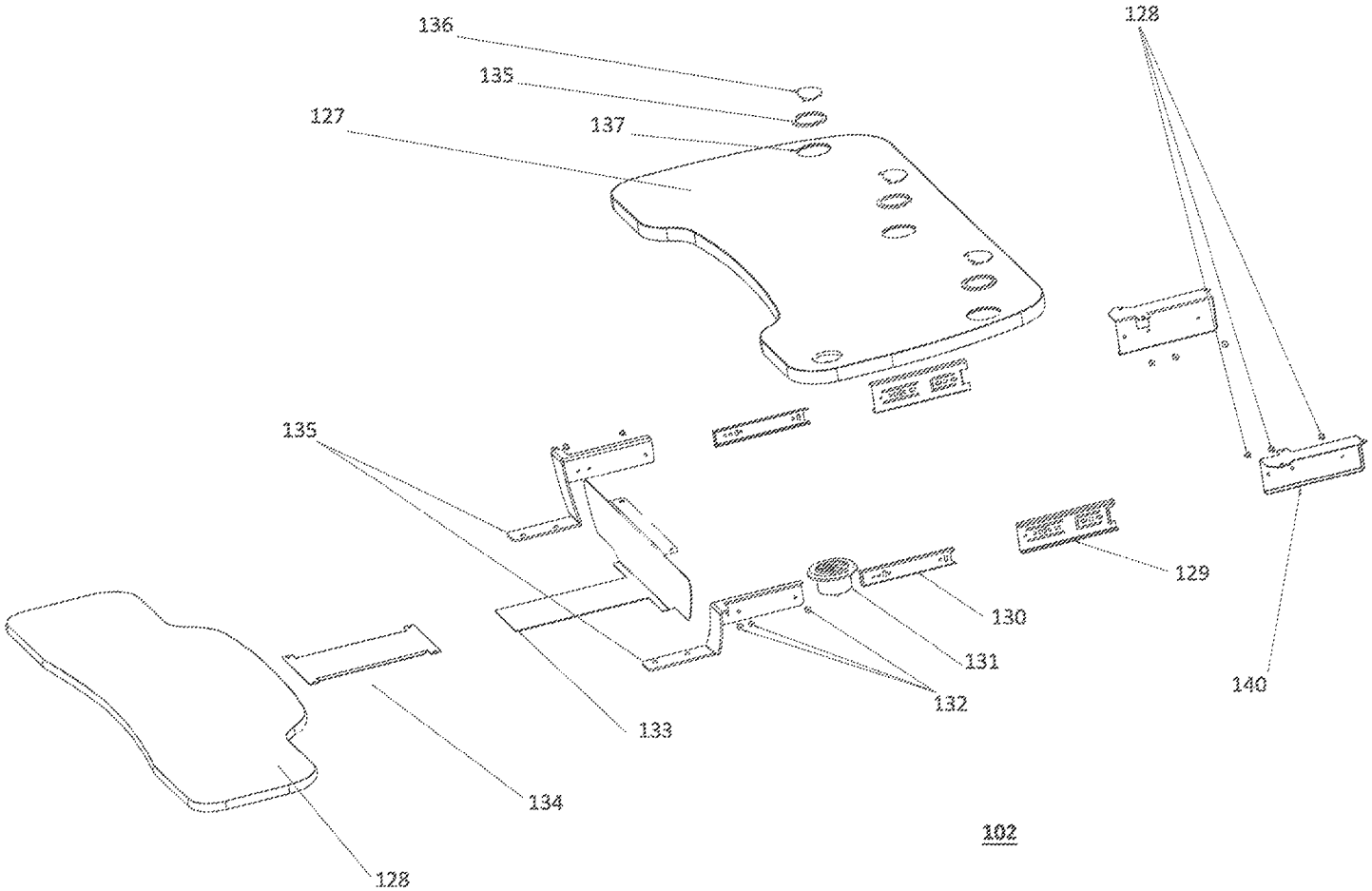
FIG. 3 shows an exploded view of the surface assembly of the exemplary desktop system.

FIG. 3 shows an exploded view of surface assembly 102. Surface assembly 102 has a main surface 127 and a keyboard tray 128. Keyboard tray is slideably attached to main surface 127 via slide bracket 140, slide outer piece 129, slide inner piece 130, surface joint and drawer slide attachment flange 135, slide flange surface joint 133, and edge folded slide guide 134. Pop rivets 128 and 132 are used to make various attachments between components. Also provided and integrated on main surface 127 is an up/down switch 131 that can be actuated to move the main surface 127 of the desktop system along a vertical axis to a desired position. Switch 131 can also have an integrated USB charger.

Keyboard tray 128 is generally provided at a position below (along a vertical axis) from main surface 127. Main surface 127 and keyboard tray 128 are attached via stationary surface joints, which are affixed to each surface via fasteners. Keyboard tray 128 is attached to main surface 127 with brackets that allow keyboard tray 128 to slide forward and backwards.

Figure 9:
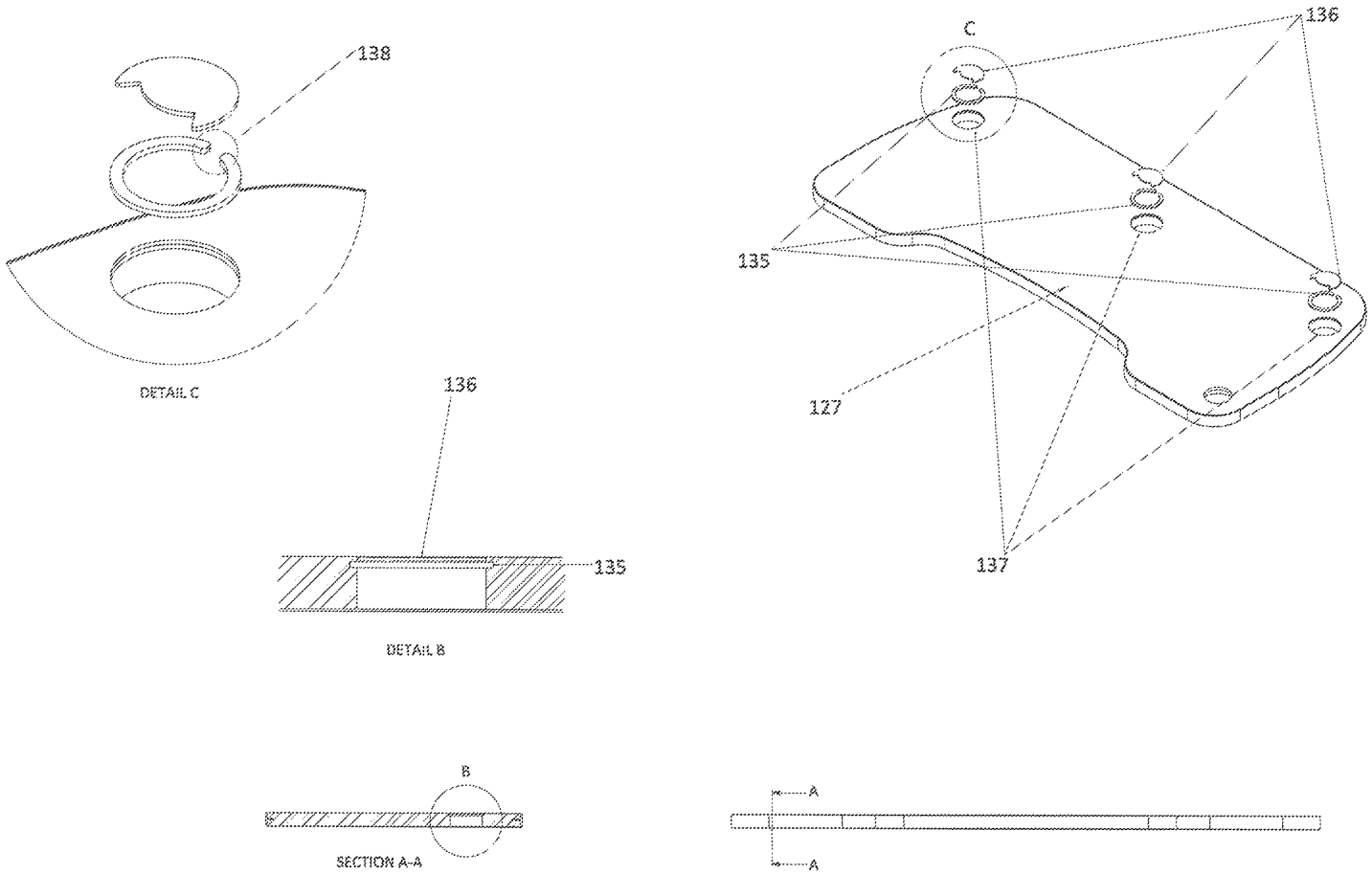
FIG. 9 shows various views of the grommet assembly.

Main surface 127 has various grommet holes 137 to allow for various cables (not shown) to pass therethrough. Grommet hole 137 holds an under grommet washer 135 and a grommet cover 136. When grommet cover 136 is placed in grommet hole 137, a flush surface is created. FIG. 9 shows further details of the grommet assembly.

Figure 4:
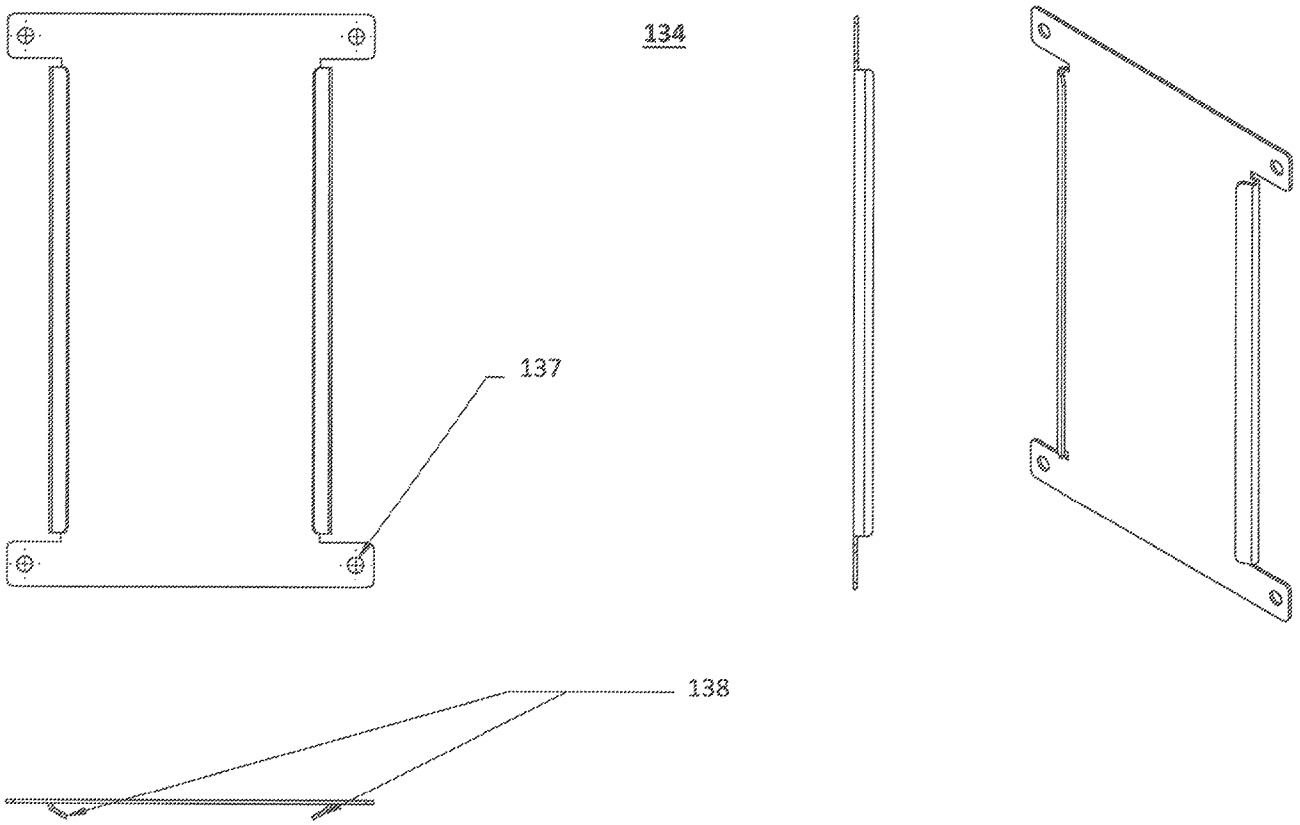
FIG. 4 shows various views of the edge-folded slide guide.
Figure 5:
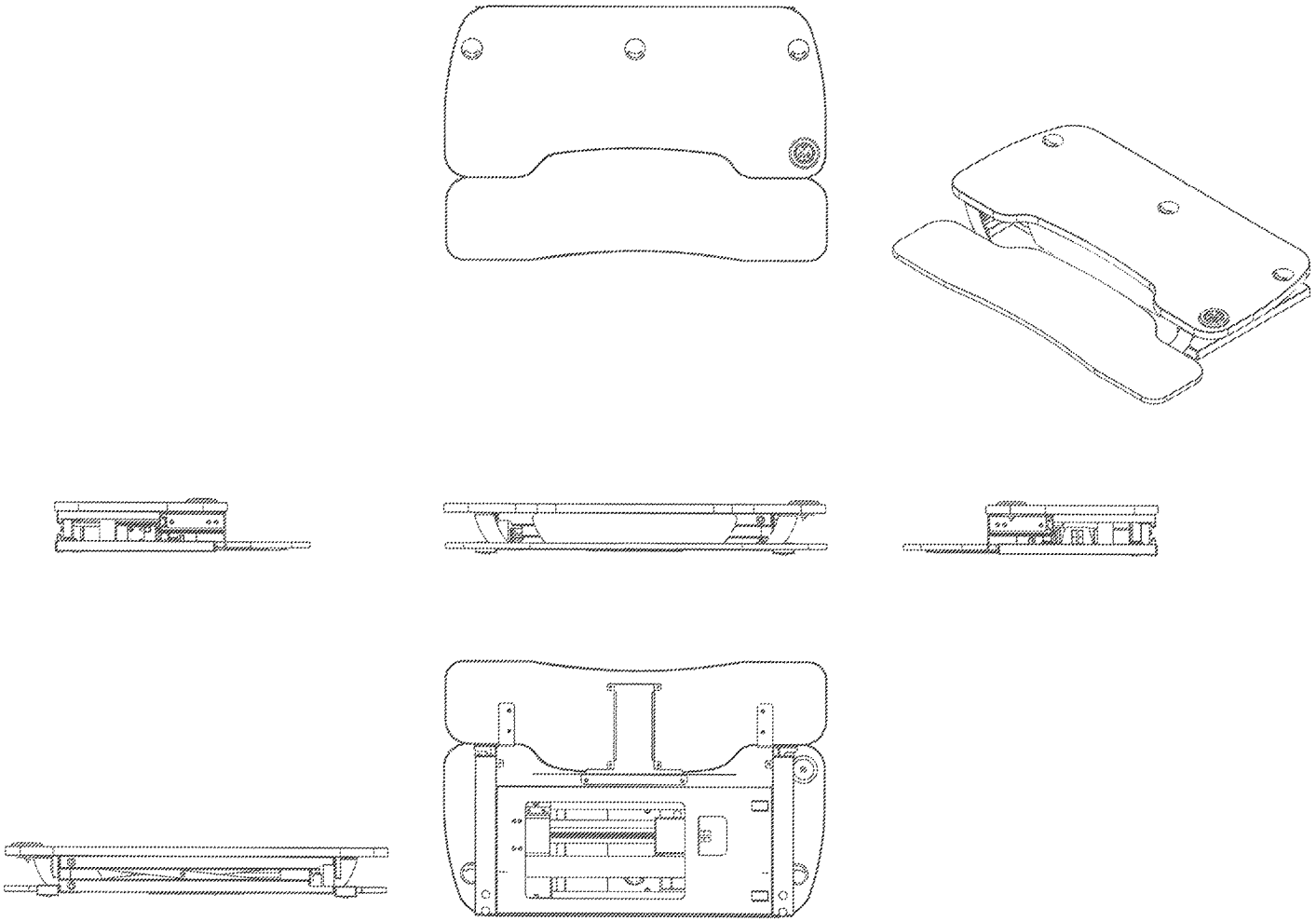
FIG. 5 shows perspective, top, bottom, and side views of the exemplary desktop system in a "down" and "closed" state.
Figure 6:
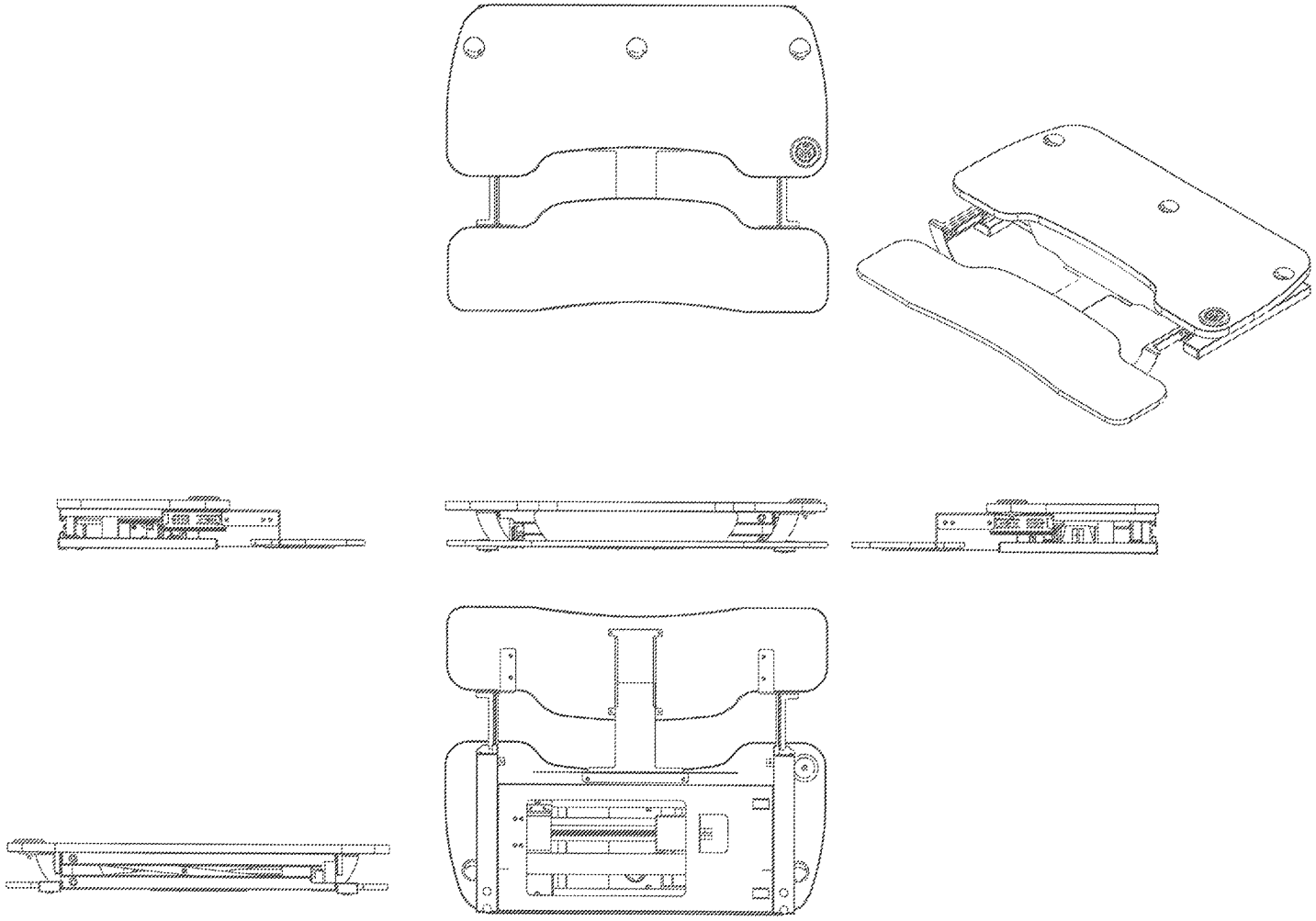
FIG. 6 shows perspective, top, bottom, and side views of the exemplary desktop system in a "down" and "open" state.

FIG. 4 shows various views of the edge folded slide guide 134. Edge folded slide guide 134 has U-shaped guides 138 for securing back and forth movement of the slide flange surface. Screw holes 137 are provided in the edge folded slide guide 134 to allow for attachment.

FIGS. 5-8 shows perspective, top, bottom, and side views of the exemplary desktop system in various "up"/"down" and "open"/"closed" states.

Figure 7:
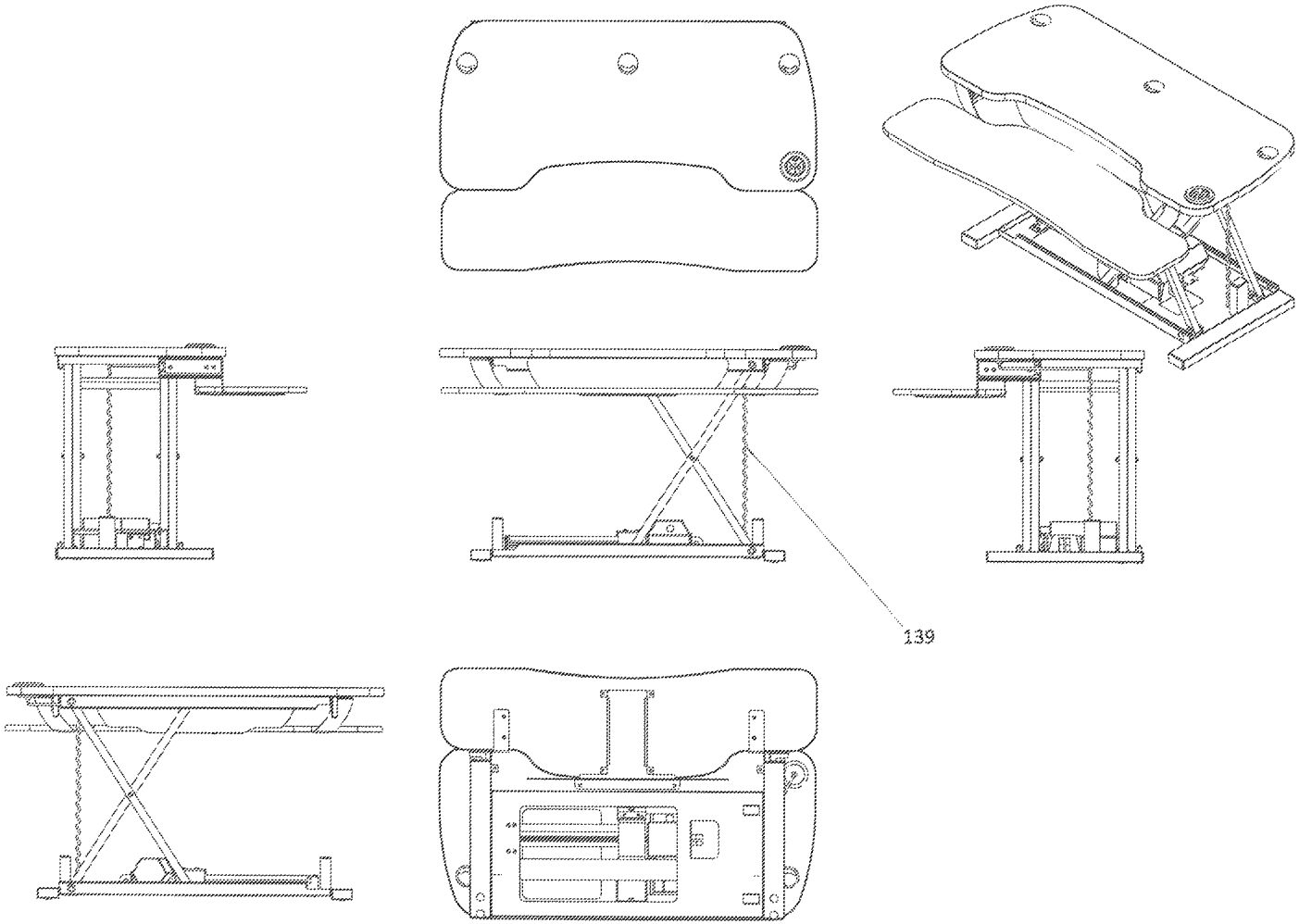
FIG. 7 shows perspective, top, bottom, and side views of the exemplary desktop system in an "up" and "closed" state.
Figure 8:
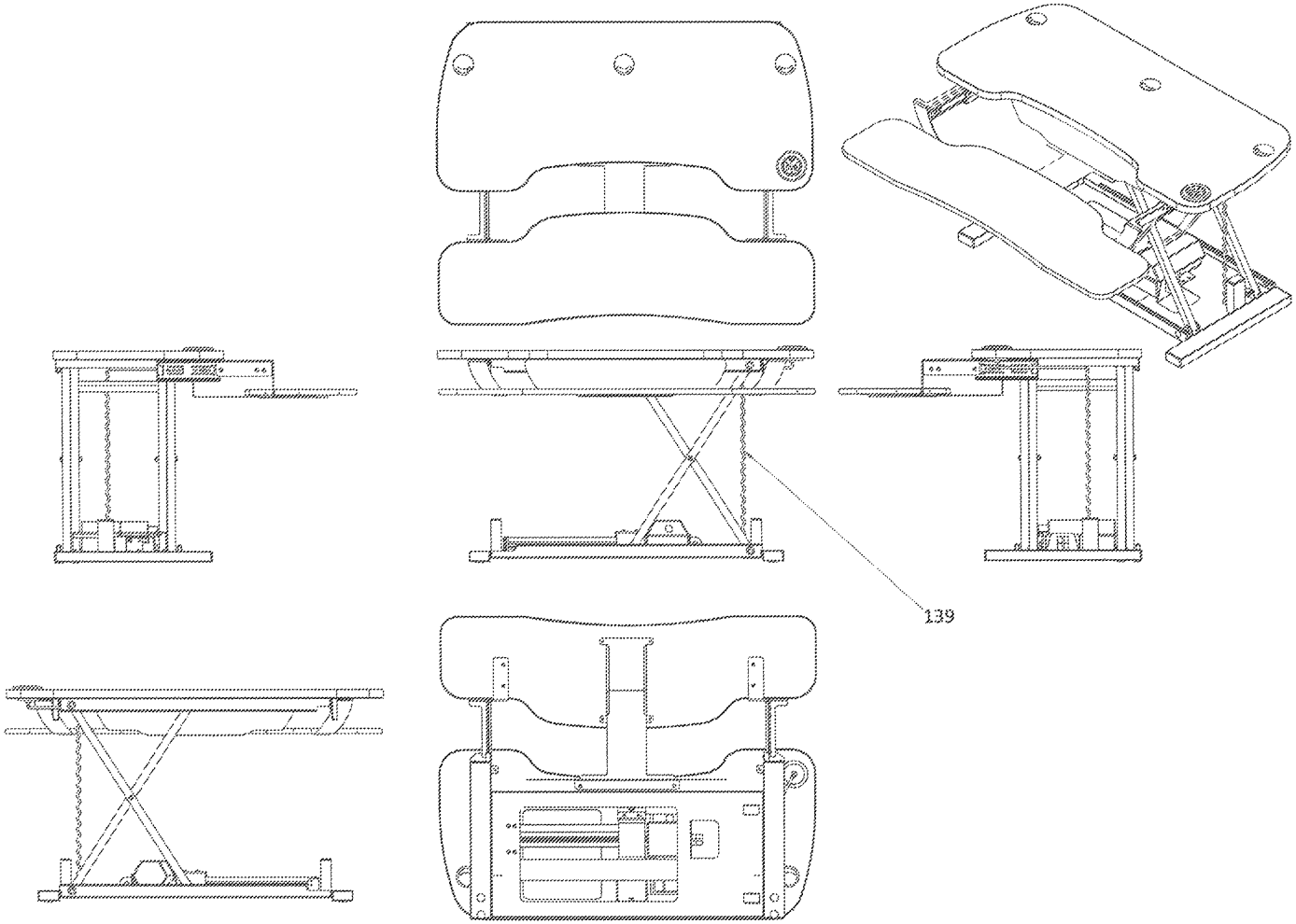
FIG. 8 shows perspective, top, bottom, and side views of the exemplary desktop system in an "up" and "open" state.

FIGS. 7 and 8 further show a coiled cord 139 to allow for effective cable management without tangling.

FIG. 9 shows main surface 127 of the surfaces assembly with grommet holes 137. Grommet hole 137 has a recessed ridge that allows grommet washer 135 to fit therein. Grommet washer 135 has a split 138 formed in the washer to allow for compression of the grommet to fit snugly within the recessed ridge. Once grommet washer 135 is placed in grommet hole, grommet cover 136 can be placed over grommet washer 135. When both grommet washer 135 and grommet cover 136 are placed in grommet hole 137, the grommet cover 136 is flush with main surface 127.

In an alternate embodiment, monitor arms may be inserted into grommet holes 137. Main surface 127 has at least one, but preferably three, grommet holes to allow for monitor arms 105 to be inserted into grommet holes. Monitor arms can be designed to support computer monitors, for example, but can support other types of screens and electronic devices. Keyboard tray is generally a flat surface capable of accommodating a keyboard, mouse, and other computer accessories.

In another exemplary desktop system, grommet hole in the center of main surface can being used by a monitor arm, which can accommodate dual screens (also referred to as "dual monitor arm"). A monitor arm capable of accommodating a single monitor, would be interchangeable by a user. Other grommet holes can similarly accommodate monitor arms of the dual or single type.

As generally discussed above, frame assembly (or lift mechanism) generally comprises upper and lower frames, and, respectively, and a linear actuator powered by a motor. Provided between and connecting upper and lower frames and are scissor arms that expand in crisscross fashion to increase the distance between upper and lower frames and fold onto each other to decrease the distance between upper and lower frames. Scissor arms can be cubic tubes, for example. Scissor arms move on roller wheels provided at an end of scissor arms. Connecting tube is also provided between scissor arms for structural support. Lift mechanism is designed to create up to an 18-inch elevation and lift up to 80 lbs. A linear actuator is a type of motor that allows movement along one axis.

Lower frame further comprises roller rail tracks on each side thereof to allow roller wheels to slide there along. Provided at the end of each roller can be stop tubes. Also on lower frame is an actuator head mounting plate to secure actuator.

Attached to the top of actuator is a moving plate, which is designed move along track. When switch is actuated, moving plate, which is attached to ends of scissor arms, move along the track, which in turn move the scissor arms in either horizontal direction, thereby raising and lowering main surface.

Actuator can be of a number of different types of actuators, for example, but without limitation, a linear track actuator or a linear telescopic rod actuator. One notable feature of this exemplary embodiment in accordance with this invention is that different types of actuators can be used.

The desktop can be available in various sizes, for example, 36", 40", and 48", in a variety of colors and finishes. An optional LED strip can also be provided for typing in dimly lit environments. Main surface 127 can be in a variety of shapes and sizes, for example, in a triangle, to fit into a corner or cubicle for enhancing even small workspaces.

As these and other variations and combinations of the features discussed above can be utilized without departing from the invention as defined by the claims, the foregoing description of exemplary embodiments should be taken by way of illustration rather than by way of limitation of the invention as defined by the claims. It will also be understood that the provision of examples of the invention (as well as clauses phrased as "such as," "e.g.", "including" and the like) should not be interpreted as limiting the invention to the specific examples; rather, the examples are intended to illustrate only some of many possible aspects.

The invention claimed is:

1. A motorized desktop stand unit comprising:

a main surface assembly designed to accommodate a monitor or laptop, the main surface having a left side, a right side, a front side, and a back side;

a secondary surface assembly slideably attached in parallel to the front side of said main surface assembly, wherein the direction of movement of the secondary surface is perpendicular to the left and right side of the main surface;

a frame assembly comprising an upper frame and a lower frame;

an elevation mechanism provided between said upper frame and lower frame; and a switch provided in said main surface assembly;

wherein the elevation mechanism comprises two pairs arms each having a roller wheel attached to a distal end relative to the main surface assembly;

wherein the scissor arms are connected at the proximal end to the left and right side of the main surface, further wherein the scissor arms are joined in the middle to form an x-shaped arrangement, the x-shaped arrangement transversely oriented from the left side to the right side when viewed by a user;

wherein when said switch is actuated, the elevation mechanism adjusts the space between said upper frame and lower frame, changing the height of the main surface assembly.

2. The motorized desktop stand unit of claim 1, wherein said elevation mechanism comprises a linear actuator.

3. The motorized desktop stand unit of claim 2, wherein when said switch is activated, the elevation mechanism moves said roller wheels along u-shaped tracks provided along said upper and lower frames.

4. The motorized desktop stand unit of claim 2, wherein the elevation mechanism further comprises a track and moving sleeve designed to move linearly along said track, wherein said moving sleeve is connected to two ends of said four scissor arms.

5. The motorized desktop stand unit of claim 1, wherein surface joints connect said main surface assembly to said secondary surface assembly.

6. The motorized desktop stand unit of claim 1, wherein said main surface assembly further comprises at least one grommet hole.

* * * * *